United States Patent [19]

Bresson

[11] Patent Number: 5,044,417

[45] Date of Patent: Sep. 3, 1991

[54] ROLLER ASSEMBLIES FOR AUTOMATICALLY WINDING AND UNWINDING CLOSURES

[75] Inventor: René Bresson, Mantoche, France

[73] Assignee: SIMU, Gray, France

[21] Appl. No.: 562,572

[22] Filed: Aug. 3, 1990

[30] Foreign Application Priority Data

Oct. 18, 1989 [FR] France ..... 89 13886

[51] Int. Cl.[5] ..... E06B 9/56

[52] U.S. Cl. ..... 160/310; 160/1

[58] Field of Search ..... 160/310, 311, 312, 133, 160/1; 242/55, 67.1 R; 318/266, 466, 468

[56] References Cited

U.S. PATENT DOCUMENTS 4,342,354 8/1982 Leivenzon et al. ..... 160/310 X
4,411,348 10/1983 Fillion ..... 160/310 X
4,417,185 11/1983 Bullat ..... 160/1 X
4,615,371 10/1986 Clauss ..... 160/310 X
4,641,700 2/1987 Zveibil ..... 160/133
4,651,940 3/1987 Nakamura ..... 160/310 X
4,974,658 12/1990 Komatsu et al. ..... 160/133 X

FOREIGN PATENT DOCUMENTS 1245064 7/1967 Fed. Rep. of Germany ..... 160/310

*Primary Examiner*—David M. Purol
*Attorney, Agent, or Firm*—Dowell & Dowell

[57] ABSTRACT

Roller assemblies having a drum upon which a closure is wound and unwound and wherein a drive mechanism within the drum is meshed with a plurality of elongated ribs extending along the inner surface of the drum and wherein the limiting controls for the drive mechanism include a pair of travelling nuts which are also meshed with the ribs of the drum for mechanically actuating the limiting controls.

3 Claims, 2 Drawing Sheets

ROLLER ASSEMBLIES FOR AUTOMATICALLY WINDING AND UNWINDING CLOSURES

BACKGROUND OF THE INVENTION

1. FIELD OF THE INVENTION

The present invention relates to automated roller devices for closures such as blinds, shades and similar devices in which the drive mechanism and all the accessories thereof are housed inside drum upon which the canvas or shade is wound.

2. Description of the Related Art

The construction of devices of above type is known to be complicated since the drum must be secured to rotate with the driven shaft of the speed reducer associated with the electrical drive motor. A connection must also be made between the drum and movable members of an end-of-stroke mechanism which ensures automatic control of the motor in both, i.e. winding and unwinding, directions. Such connections generally employ pulleys or wheels which are fixed to the drum by radial screws which are relatively delicate to position and this consequently complicates the assembly operations, thus increasing the cost of the device.

SUMMARY OF THE INVENTION

It is a principal object of the present invention to overcome the aforementioned drawbacks essentially by providing the inner wall of the drum with a series of regularly spaced longitudinal grooves which cooperate with both a drive member having a toothed periphery and which is fitted on the driven shaft of the speed reducer and with two pinions which form travelling nuts for controlling the end-of-stroke mechanism.

BRIEF DESCRIPTION OF THE DRAWINGS

The invention will be more readily understood on reading the following description with reference to the accompanying drawings, in which.

DESCRIPTION OF THE PREFERRED EMBODIMENT

Figure 1:
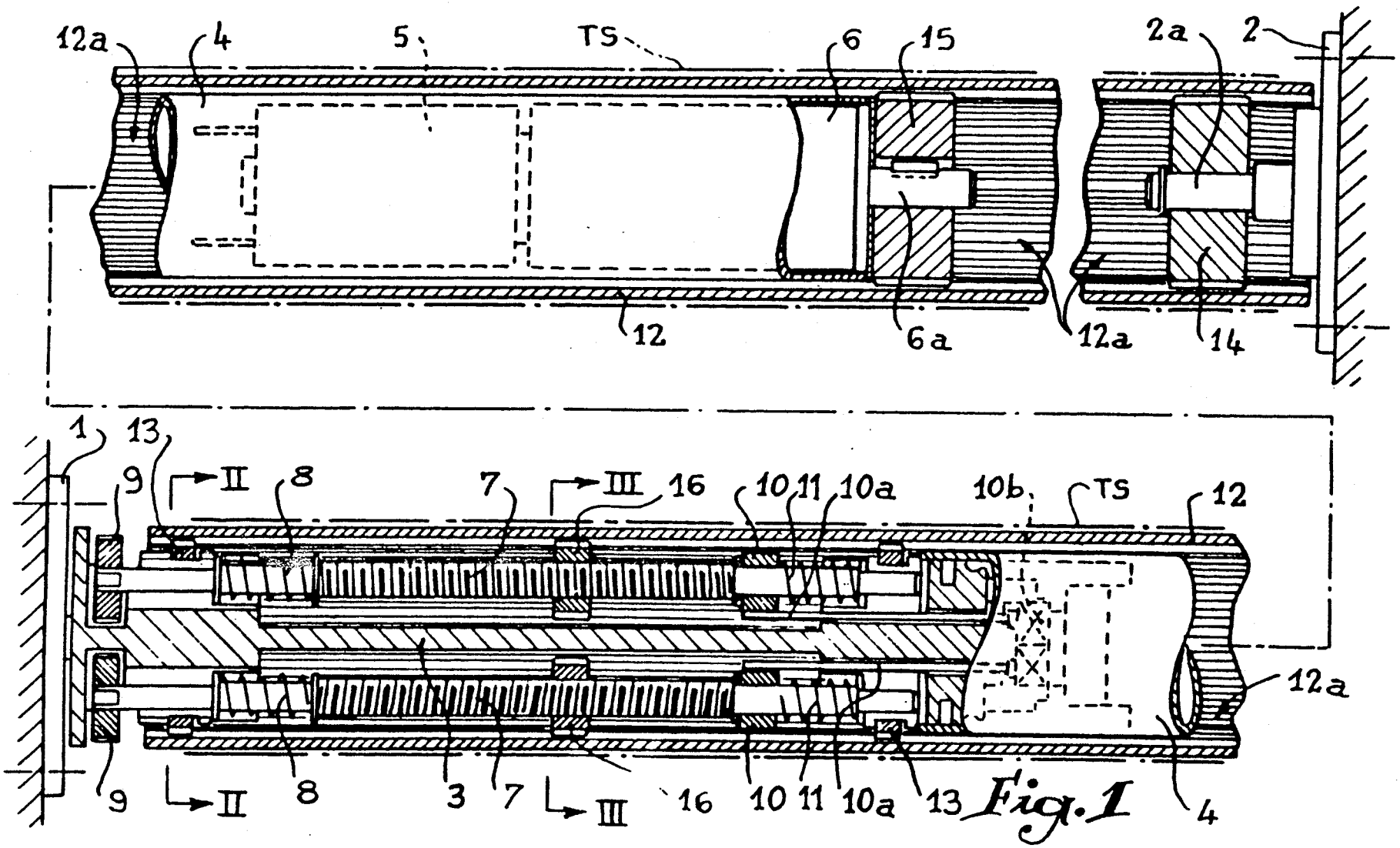
FIG. 1 is a schematic axial section through a roller blind or similar device, according to the present invention.

Referring now to the drawings, the device shown therein comprises, in manner known per se, two end brackets 1 and 2 adapted to be fixed, most often by means of screws, in the lateral walls of a window frame or other opening in a premises. Bracket 1 is secured to an axial frame 3 on the free end of which is fitted a casing 4 containing the electrical drive motor 5 and the speed reducer 6 which is associated therewith.

The frame 3 is arranged to support the end-of-stroke mechanism which ensures automatic control of the motor 5. This mechanism comprises two threaded rods 7 oriented parallel to each other along the axis of the frame. Each of these rods 7 is associated with a spring 8 which ensures its orientation while allowing rotation thereof with the aid of a knurled rotating member 9, so as to provide for the precise adjustment of the mechanism at the two ends-of-stroke of the canvas or shade. Opposite the member 9, each rod 7 supports a sliding pusher 10 which is subjected to the action of a spring 11 and which cooperates by a longitudinal extension **10*a* with an electrical contactor 10*b* connected to the supply circuit of the motor 5**.

In conventional manner, the device further comprises a drum 12 to which the convas or shade of the blind Ts is secured. According to the invention, this drum 12 is internally ribbed, the ribs **12*a*** extending along the whole length of the wall of the drum.

Figure 2:
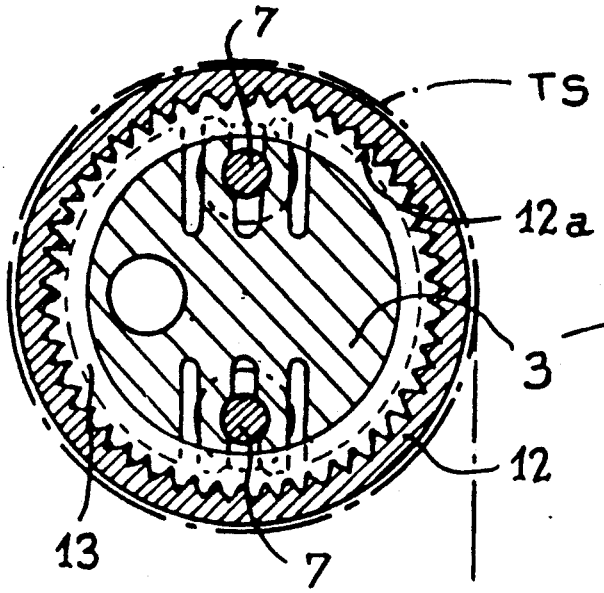
FIGS. 2 and 3 are transverse sections along the planes indicated at II-II and III-III in FIG. 1.

The drum is supported in rotation about the frame 3 by two rings 13 (FIG. 2) whose periphery is notched so as to cooperate with the ribs **12*a* of the drum, while its axial opening, provided to have a smooth wall, rotates freely on a cylindrical bearing surface of the frame. At the fixing bracket 2, the end of the drum 12 is supported in the same manner by a toothed ring 14, in the present case provided to be longer and mounted on a pin 2*a*** on the bracket.

Drum 12 is driven in rotation by a cylindrical drive piece 15 which is keyed on the driven shaft **6*a* of the speed reducer 6 and of which the periphery is toothed so as to mesh with the ribs 12*a*** of the drum.

Figure 3:
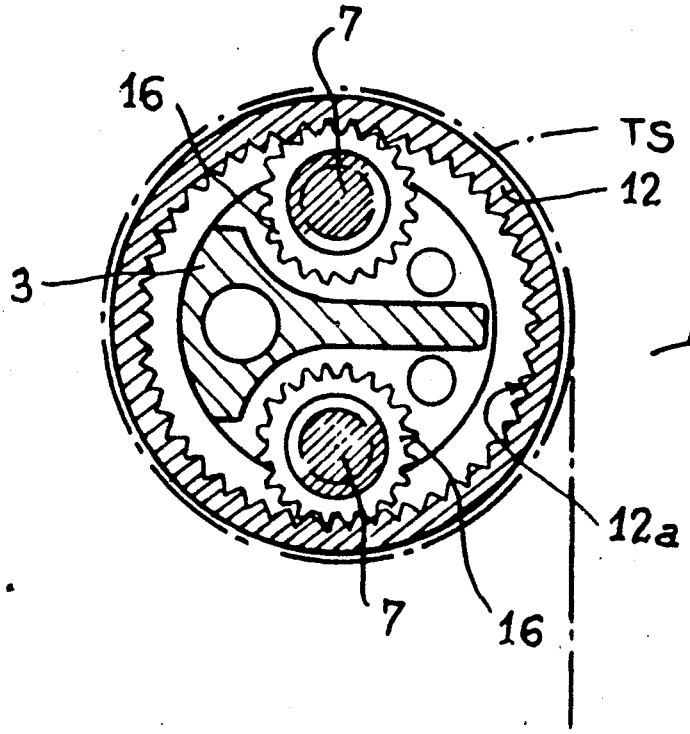

For controlling the pushers 10 of the end-of-stroke mechanism, there is mounted on each threaded rod 7 a travelling nut formed by a pinion 16 which, as shown in FIG. 3, meshes directly with the ribs **12*a* of the drum 12. These pinions or nuts 16 therefore move axially along the rods 7 during rotation of the drum 12** and consequently actuate the contactors of the above-mentioned mechanism alternately (the threads of the two rods being so that nuts move in opposite directions.

The advantages presented by the above-described structure will be readily appreciated. Drum 12 is assembled by longitudinally sliding the drum over the meshing components prior to being fixed to the lateral bracket 2. The ribs **12*a* thus cooperates directly with the rings 13 and 14, the travelling pinions or nuts 16 and the toothed drive piece 15**. No angular connection screw is necessary.

It goes without saying that the number of rings 13 and 14 may vary to a large extend, depending in particular on the length of the drum 12 and the load to which it is subjected.

It must, moreover, be understood that the foregoing description has been given only by way of example and that it in no way limits the domain of the invention which would not be exceeded by replacing the details of execution described by any other equivalents.

What is claimed is:

1. A roller assembly for automatically winding and unwinding closures comprising, a hollow rotatable drum for supporting a closure, said drum having inner and outer surfaces, a drive mechanism disposed within said drum, said drive mechanism including an electric motor and a speed reducer driven by said motor, said speed reducer having a driven shaft, said drum having a plurality of regularly spaced internal ribs extending along substantially the entire length of said inner surface thereof, a cylindrical drive piece mounted to said driven shaft, said drive piece having outer peripheral teeth engaging said internal ribs of said drum so that said drum is rotated by said drive piece, electrical contact means mounted within said drum for controlling said motor to limit the winding and unwinding of the roller assembly, ring means for supporting said drum about said drive mechanism, said ring means having outer peripheral teeth engaging said internal ribs of said drum, and travelling nut means mounted within said drum and having outer peripheral teeth engaging said internal ribs of said drum, said travelling nut means being movable upon the rotation of said drum to activate said electrical contact means to limit the winding or unwinding of the roller assembly.

2. The roller assembly of claim 1 in which said travelling nut means includes a pair of parallel threaded rods mounted within said drum, a travelling nut threadedly engaging each of said rods, said travelling nuts being movable in opposite directs upon the rotation of said drum, a pusher element resiliently mounted adjacent one end of each of said rod means, said pusher elements having extensions for engaging said electrical contact means, said pusher elements being urged by said travelling nuts to cause said extensions to engage said electrical contact means.

3. The roller assembly of claim 2 including a rotatable member mounted to each of said rods adjacent a second end thereof for adjusting the positions of said travelling nuts with respect to said rods.

* * * * *